US008713949B2

(12) United States Patent
Chase et al.

(10) Patent No.: US 8,713,949 B2
(45) Date of Patent: May 6, 2014

(54) ICE LEVEL AND QUALITY SENSING SYSTEM EMPLOYING DIGITAL IMAGING

(75) Inventors: Kevin M. Chase, St. Joseph, MI (US); Randell L. Jeffery, Stevensville, MI (US); Matthew J. Nibbelink, St. Joseph, MI (US); Kitman Chan, East Lansing, MI (US); Jordan Cohen, West Bloomfield, MI (US); Andrew Gilgallon, Commerce, MI (US); Dan Medore, Clio, MI (US); Surisack Phouapanya, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1282 days.

(21) Appl. No.: 11/741,344

(22) Filed: Apr. 27, 2007
(Under 37 CFR 1.47)

(65) Prior Publication Data

US 2008/0264074 A1 Oct. 30, 2008

(51) Int. Cl.
*F25C 1/00* (2006.01)
*F25C 5/18* (2006.01)

(52) U.S. Cl.
USPC ..... 62/137; 62/125; 62/344; 73/32 R

(58) Field of Classification Search
USPC ..... 72/32 R; 62/135–137, 344, 125–126; 73/32 R
See application file for complete search history.

(56) References Cited

U.S. PATENT DOCUMENTS

| | | | | |
|---|---|---|---|---|
| 2,983,109 | A * | 5/1961 | Leeson | 62/73 |
| 6,919,795 | B2 * | 7/2005 | Roseen | 340/309.16 |
| 2002/0002831 | A1 * | 1/2002 | Huffman et al. | 62/137 |
| 2006/0174641 | A1 * | 8/2006 | Liu et al. | 62/246 |
| 2006/0178578 | A1 * | 8/2006 | Tribble et al. | 600/432 |
| 2006/0209072 | A1 * | 9/2006 | Jairam et al. | 345/440 |
| 2007/0209384 | A1 * | 9/2007 | Stewart et al. | 62/457.2 |

FOREIGN PATENT DOCUMENTS

JP 2003-42626 A * 2/2003 ..... F25D 11/00

* cited by examiner

*Primary Examiner* — Cassey D Bauer

(57) ABSTRACT

A refrigerator includes a sensing system for detecting a level and quality of ice cubes in an ice cube storage bin. The sensing system employs a digital image capture device that is coupled to a digital image analyzing system which scans digital images of the ice cube storage bin captured by the digital image capture device to determine a level of ice cubes in the ice cube storage bin. Digital images of the ice cubes are contrasted against a reference image which provides a point of comparison for determining the level of ice cubes in the ice cube storage bin and controlling ice production cycles of the ice maker. The sensing system also analyzes edge portions of the ice cubes to determine ice cube quality.

14 Claims, 5 Drawing Sheets

ICE LEVEL AND QUALITY SENSING SYSTEM EMPLOYING DIGITAL IMAGING

BACKGROUND OF THE INVENTION

1. Field of the Invention

The present invention pertains to the art of refrigerators and, more particularly, to a sensing system that employs digital imaging technology to determine a level and/or quality of ice cubes in an ice cube storage bin.

2. Description of the Related Art

Sensing a level of ice cubes in an ice cube storage bin is well known in the art. That is, refrigerators that employ automatic ice makers have, for years, employed a mechanism of one form or another to detect a level of ice in an ice cube storage bin. Basically, when the level of ice reaches a predetermined point, the ice maker is deactivated to prevent overflow. Most level sensing arrangements employ a bale arm that is pivotally mounted to the ice maker. The bale arm extends into the ice cube storage bin and is acted upon by ice cubes contained therein. More specifically, as the level of ice cubes in the ice cube storage bin rises, the bale are is urged upward. When the level of ice cubes reaches a predetermined point, the bale arm acts upon a switch to temporarily shut off the ice maker, thereby halting ice production. When the level of ice cubes falls below the predetermined point, the bale arm moves downward, the ice maker is activated and a new ice production cycle is initiated.

Over time, manufacturers developed more advanced systems for detecting a level of ice in an ice cube storage bin. The more advanced systems were particularly developed for door mounted ice cube storage bins where the use of bale arms is inappropriate or impractical. These more advanced systems employ various types of electronic sensors, such as infrared, ultrasonic, capacitive and even weight sensors in order to determine the level of ice in the ice cube storage bin and control operation of the ice maker.

Regardless of the existence of various known ice level sensing devices, there is still a need for further advancements in ice level sensing. More specifically, there exists a need for a more versatile ice level sensing system that employs digital imaging technology and which is capable of sensing a level of ice cubes and/or a quality of the ice cubes in an ice cube storage bin.

SUMMARY OF THE INVENTION

The present invention is directed to a refrigerator including a cabinet having top, bottom, rear and opposing side walls that collectively define a refrigerator body having a freezer compartment. The refrigerator further includes a door mounted to the cabinet for selectively providing access to the freezer compartment. The freezer compartment is provided with an ice maker, with the formed ice being stored in an ice cube storage bin. In accordance with the invention, the refrigerator employs an ice cube sensing system that utilizes digital images to determine a property, particularly level and/or quality, of ice cubes in the ice cube storage bin.

More specifically, the ice cube sensing system employs a digital image capture device which is focused upon the ice bin. The digital image capture device is coupled to a digital image analyzing system that scans digital images of the ice cube storage bin to determine a level of ice cubes in the ice cube storage bin. More specifically, the ice cube storage bin is positioned between the digital image capture device and a reference image having multiple distinct regions. Digital images of the ice cubes, contrasted against the reference image, are passed to the analyzing system. The reference image provides a point of comparison by which the analyzing system can determine the level of ice cubes in the ice cube storage bin and control ice production cycles of the ice maker.

In further accordance with of the invention, in addition to determining the level of ice cubes, the system also analyzes the quality of the ice cubes in the ice cube storage bin. More specifically, the analyzing system employs an edge detection algorithm to determine edge quality of the ice cubes. If edge quality is low, a signal is provided on a user interface indicating a need to refresh the ice cubes. In order to better detect edge quality, the digital image capture device bathes the ice cubes in colored light for better edge contrast. The digital image capture device also employs non-visible light in order to reveal other properties, such as clarity, of the ice cubes.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
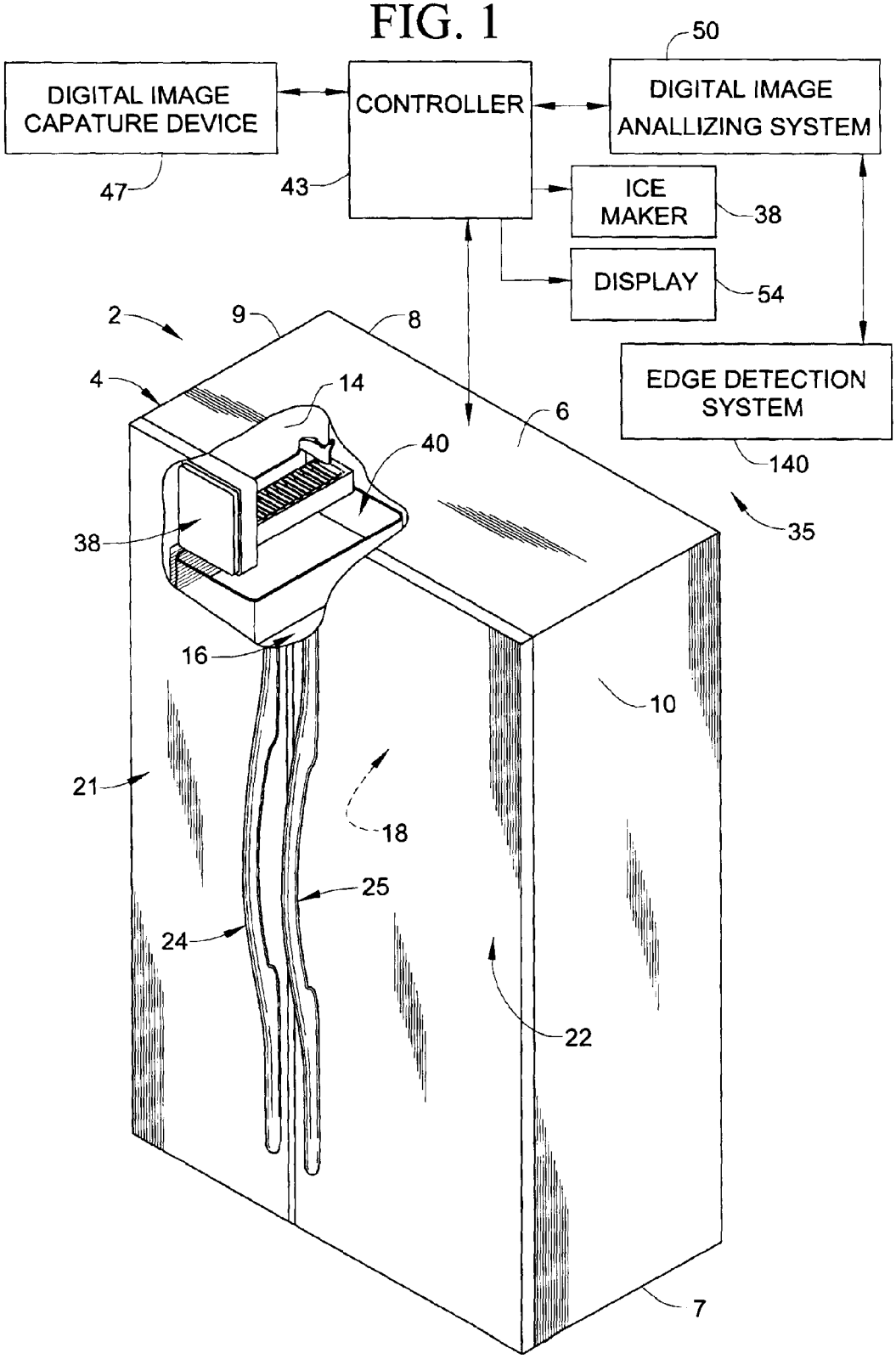
FIG. 1 is an upper left perspective view of a refrigerator incorporating an ice level and quality sensing system constructed in accordance with the present invention.

As best shown in FIG. 1, a refrigerator constructed in accordance with the present invention is generally indicated as 2. Refrigerator 2 includes a cabinet 4 having a top wall 6, a bottom wall 7, a rear wall 8, and opposing sidewalls 9 and 10 that collectively define a refrigerator body. Refrigerator 2 is further shown to include a liner 14 that defines a freezer compartment 16. A fresh food compartment 18 is arranged alongside freezer compartment 16 such that refrigerator 2 defines a side-by-side model. Of course, it should be understood that the present invention can be readily incorporated into various refrigerator models, including top mount, bottom mount and French-style door model refrigerators. At this point, it should also be understood that the referenced freezer compartment 16 could be constituted by a dedicated ice producing section provided in the fresh food compartment. In any case, in the exemplary embodiment shown, refrigerator 2 includes a freezer compartment door 21 and a fresh food compartment door 22 pivotally mounted to cabinet 4 for selectively providing access to freezer compartment 16 and fresh food compartment 18 respectively. In a manner also known in the art, each compartment door 21, 22 includes a corresponding handle 24, 25.

In accordance with the invention, refrigerator 2 is provided with an ice making system 35 including an automatic ice maker 38 positioned above a transparent ice cube storage bin 40. As will be discussed more fully below, ice making system 35 automatically detects a level and quality of ice cubes contained within ice cube storage bin 40. Towards that end, ice making system 35 includes a controller 43 which receives input from a digital image capture device 47. Digital images from digital image capture device 47 are passed to a digital image analyzing system 50 which preferably determines both the level and quality of ice cubes within ice cube storage bin 40. Level data is passed to controller 43 to establish ice production cycles for ice maker 38. More specifically, if digital image analyzing system 50 determines that a level of ice cubes in ice cube storage bin 40 is below a predetermined level, controller 43 will signal ice maker 38 to continue ice production. However, in the event that digital image analyzing system 50 determines that the level of ice cubes in ice cube storage bin 40 is at or above the predetermined level, controller 43 signals ice maker 38 to cease ice production. Also, if digital image analyzing system 50 determines that the quality of ice cubes within ice cube storage bin 40 is below a predetermined level, a signal is presented on a display 54, such as an LCD display, indicating that the ice cubes should be replaced.

Figure 2:
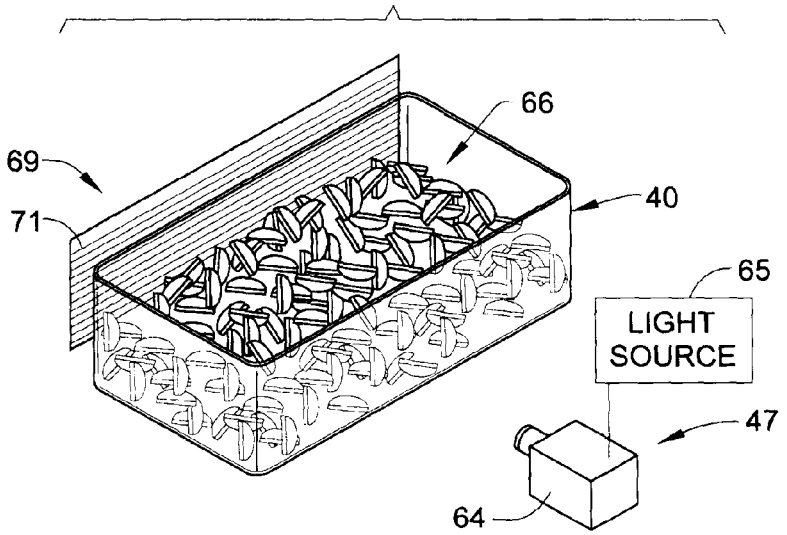
FIG. 2 is an upper right perspective view of a digital image capture portion of the ice level and quality sensing system of the present invention.
Figure 3:
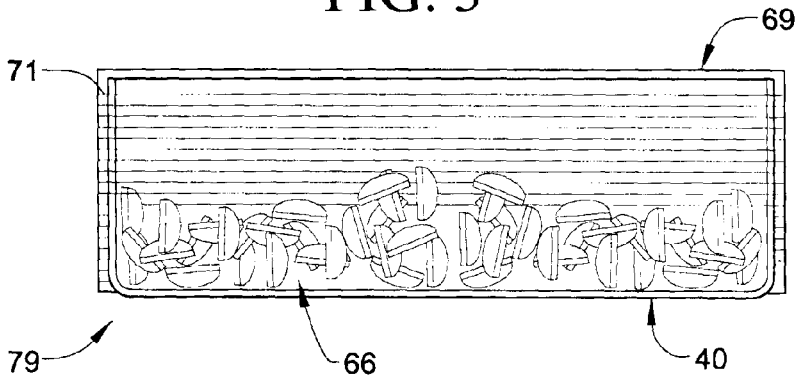
FIG. 3 is a side elevational view of an ice bin illustrating ice cubes contrasted against a referenced image.
Figure 4:
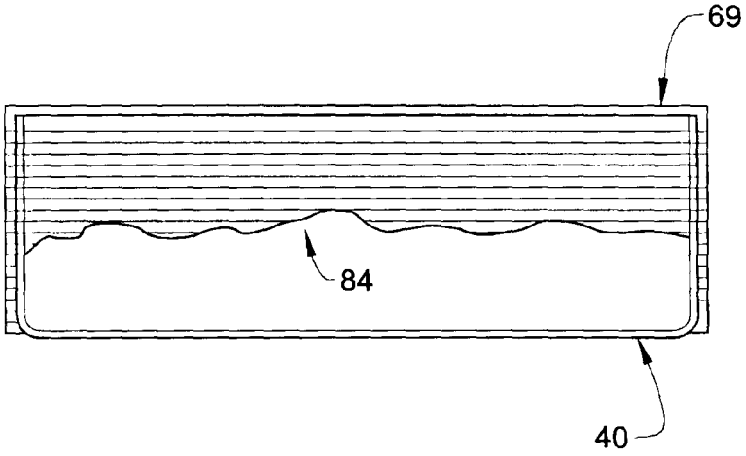
FIG. 4 is a side elevational view illustrating a level indication captured by the digital image capture device of FIG. 2.
Figure 5:
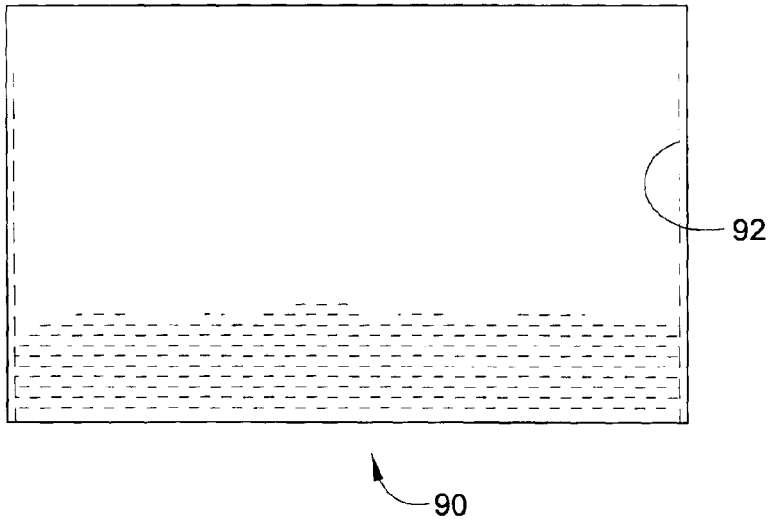
FIG. 5 is a mathematical representation of a level of ice contained within an ice cube storage bin.

As best shown in FIG. 2, digital image capture device 47 takes the form of a digital camera 64. Digital camera 64 can take on a variety of forms, such as a charged/coupled device (CCD) camera or complimentary metal oxide semiconductor (CMOS) camera. Digital camera 64 is preferably operatively connected to a light source 65 which produces light of one or more wavelengths. That is, light source 65 can bathe ice cube storage bin 40 in white light, colored light or non-visible light depending upon a particular parameter of interest. In any case, digital camera 64 is operated to capture digital images of ice cubes 66 stored within ice cube storage bin 40. Ice cubes 66 are contrasted against a reference image 69 for clarity. More specifically, in order to provide an appropriate background, ice bin 40 is arranged between reference image 69 and digital camera 64. In the embodiment shown, reference image 69 includes multiple distinct regions 71 which repeat within reference image 69. However, reference image 69 could also be a solid image or simply any desired image chosen to provide contrast for ice cubes 66. In the depicted embodiment, digital camera 64 is positioned to capture a side view 79 of ice cube storage bin 40, such as shown in FIG. 3, to develop an image profile 84 of ice cubes 66 such as shown in FIG. 4. As will be discussed more fully below, image profile 84 is passed to digital image analyzing system 50. Analyzing system 50 creates a mathematical representation 90 of image profile 84 for evaluation purposes as illustrated in FIG. 5. Mathematical representation 90 includes a level indicator or metric 92 which enables analyzing system 50 to determine an actual level of ice cubes 66 in ice cube storage bin 40.

Figure 6:
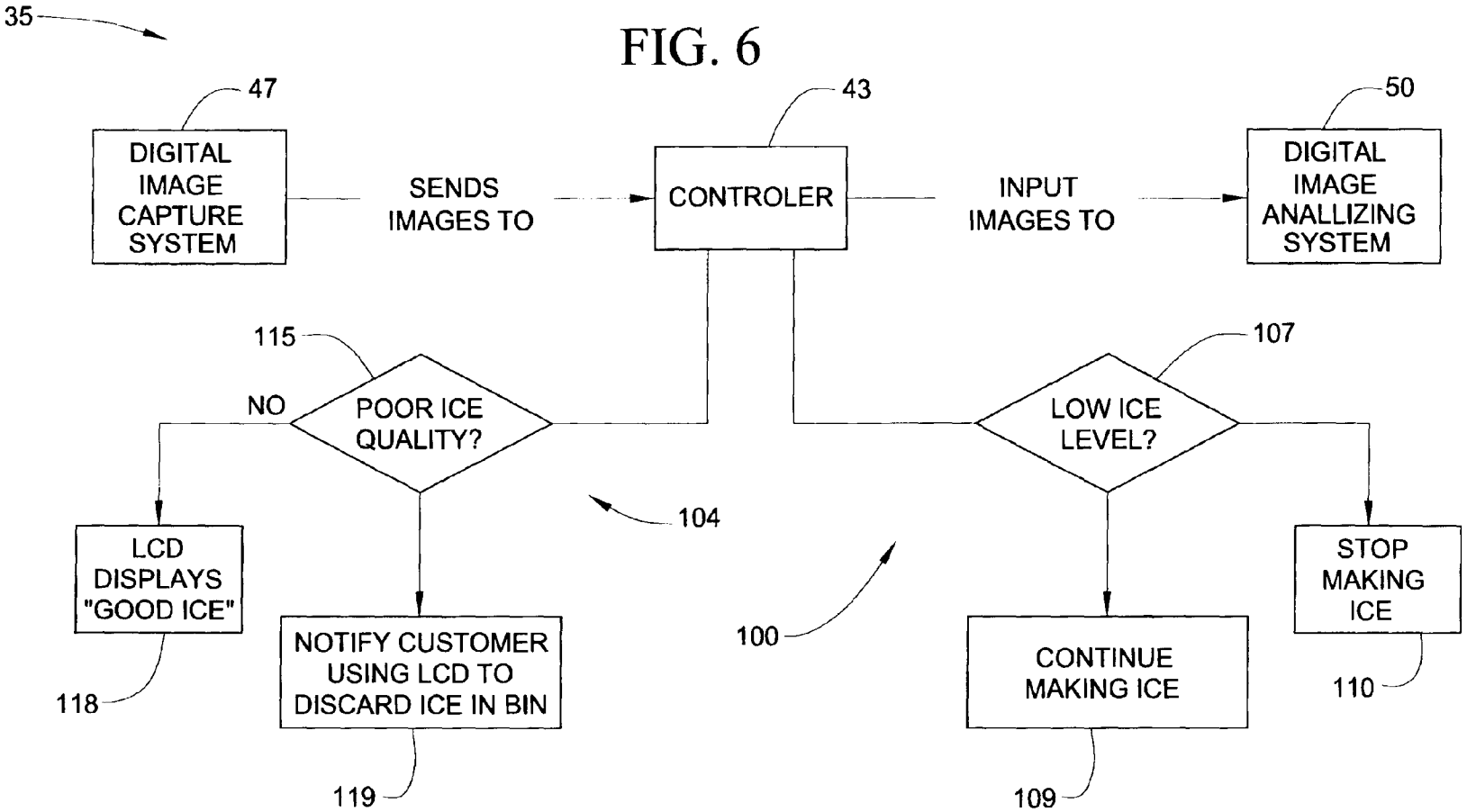
FIG. 6 is a flow chart illustrating an ice level and quality sensing algorithm employed in the present invention.

Reference will now be made to FIG. 6 in describing the operation of ice making system 35 of the present invention. As shown, ice making system 35 includes a first or level analysis portion 100 and a second or quality analysis portion 104. As will be detailed more fully below, level analysis portion 100 determines the particular level of ice cubes 66 within ice cube storage bin 40. More specifically, digital image capture device 47 periodically captures and sends digital images, such as shown in FIG. 4, to controller 43. Controller 43 passes the digital images to digital image analyzing system 50 which produces mathematical representation 90. At this point, analyzing system 50 determines an ice level in ice cube storage bin 40. The result is passed back to controller 43 for review in step 107. If the level of ice is below a predetermined level, controller 43 signals ice maker 38 to continue making ice in block 109. If, however, the level of ice is at or above the predetermined, desired level, controller 43 signals ice maker 38 to cease ice production at 110.

As noted above, in addition to determining a level of ice within ice bin 40, ice making system 35 is also capable of determining a quality of the ice within ice cube storage bin 40. As will be detailed more fully below, if controller 43 determines that the quality of ice within ice cube storage bin 40 at 115. If the quality of ice is acceptable, display 54 will indicate that the ice is fresh at 115. If the quality is poor, a signal is passed to display 54 indicating that ice cubes 66 should be discarded at 119. After the ice is discarded, ice maker 38 will produce fresh ice which is deposited into ice storage bin 40.

Figure 7:
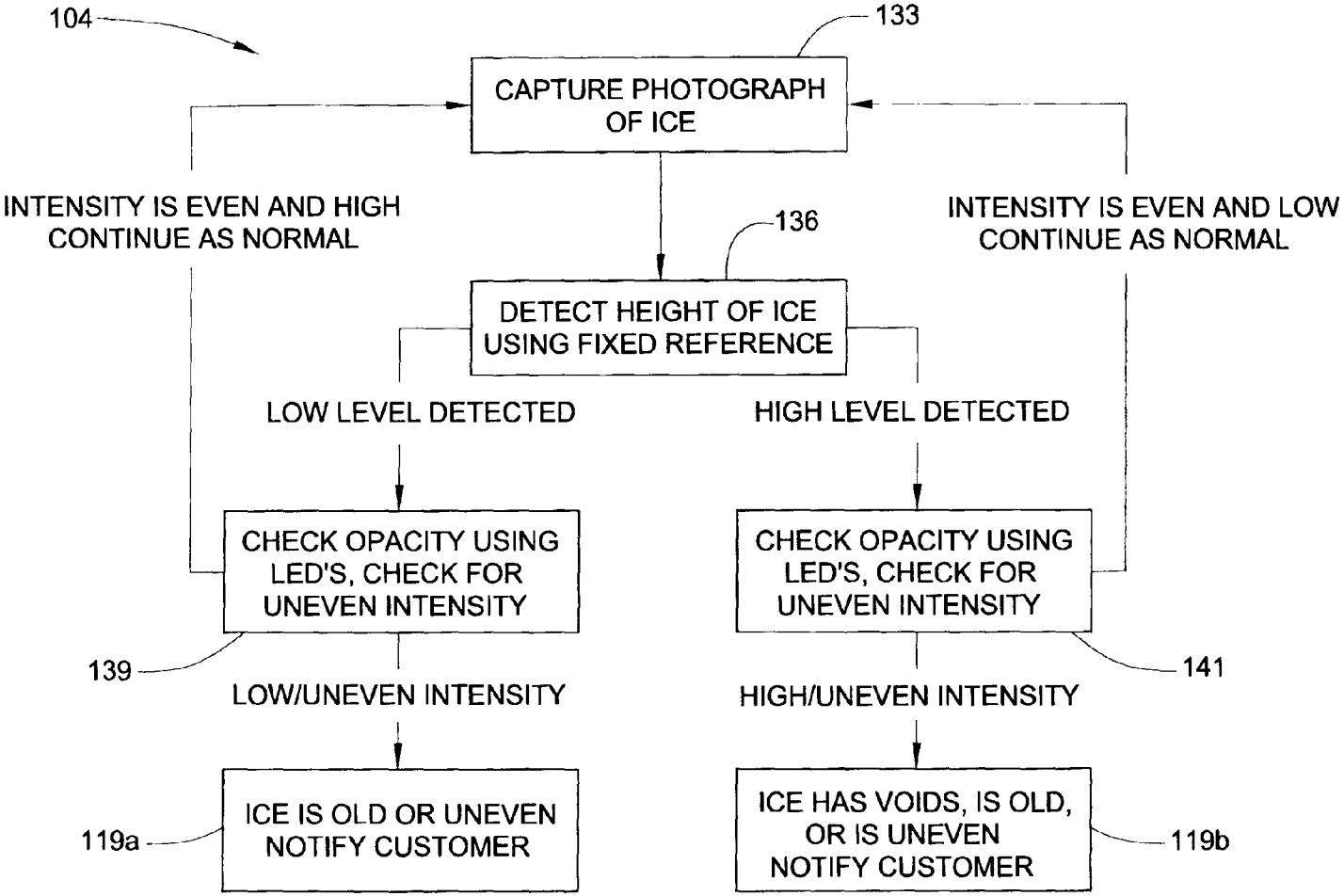
FIG. 7 is a flow chart presenting the details of the quality sensing portion of the ice level and quality sensing system of FIG. 6.

Reference will now be made to FIG. 7 in describing the particulars of quality analysis portion 104 of ice maker system 35. As shown, digital image capture device 47 first captures a photograph or digital image of ice within ice cube storage bin 40 in step 133. The digital image is analyzed by digital image analyzing system 50 to determine a level of ice cubes within ice cube storage bin 40 in step 136. If the level of ice cubes is low, digital camera 64 activates light source 65 which bathes ice cubes 66 in light and a new digital image is captured in step 139. The new digital image is passed back to digital image analyzing system 50 for analysis. Analyzing system 50 includes an edge detection portion 140. Edge detection portion 140 employs an edge detection algorithm to determine if edge portions of ice cubes 66 are sharp (indicating that the ice is fresh) or rounded (indicating that the ice cubes are older). Digital image analyzing system 50 also evaluates the intensity of ice cubes 66 obtained in the new digital image. If the level of ice cubes 66 is low and the intensity of the ice cubes is uneven, a determination is made that the ice cubes are old and should be discarded. As noted above, a signal is passed to display 54 in step 119*a* to notify the user that the ice cubes 66 are no longer fresh. Correspondingly, if the level of ice cubes 66 in ice cube storage bin is at or above the predetermined level, digital camera 64 activates light source 65 and captures an image of the ice cubes within ice cube storage bin 40 in step 141 using, for example, non-visible light. The image captured in step 141 is passed back to digital image analyzing system 50 for analysis. After evaluating edge portions of ice cubes 66, analyzing system 50 evaluates the intensity of the digital image. If analyzing system 50 determines that the level of ice cubes in ice cube storage bin is high and the image captured in step 141 is uneven, a determination is made that the ice cubes contain voids, are old (e.g. soft with rounded edges) or uneven and should be replaced. This determination is signaled on display 54 in step 119*b*.

Based on the above, it should be readily understood that the present invention enables a refrigerator to automatically control ice production to ensure that consumers have an adequate or desired amount of ice. In addition to ensuring an adequate supply of ice, the sensing system of the present invention enables the quality of the ice in the ice cube storage bin to be determined. Thus, consumers are provided the option of discarding ice that may be less than fresh. Although described with reference to a preferred embodiment of the invention, it should be readily understood that various changes and/or modifications can be made to the invention without departing from the spirit thereof. For instance, it should be understood that the number and location of cameras can vary in accordance with the present invention. For example, cameras can be located above, behind, alongside or even below the ice cube storage bin to capture digital images. Also, it should be noted that the particular color of light employed by the light source can vary in accordance with the present invention to include white light, various colors of light, and, non-visible light in order to reveal different properties of the ice cubes. Furthermore, while shown in the main portion of the freezer compartment, the ice cube storage bin and, for that matter, the ice maker can be door mounted in the freezer compartment or, as indicated above, even provided in a dedicated freezer compartment located within the fresh food compartment of the refrigerator. In general, the invention is only intended to be limited by the scope of the following claims.

What is claimed is:

1. A refrigerator comprising:

a cabinet including top, bottom, rear and opposing side walls that collectively define a refrigerator body having a freezer compartment;

a door for selectively providing access to the freezer compartment;

an ice maker mounted in the freezer compartment;

an ice cube storage bin for receiving ice cubes from the ice maker;

a digital image capture device focused upon the ice cube storage bin; and a digital image analyzing system operatively connected to the digital image capture device, said digital image analyzing system configured to evaluate digital images of ice cubes in the ice cube storage bin captured by the digital image capture device to determine a level of ice cubes in the ice cube storage bin, wherein the digital image analyzing system is further configured to evaluate edge portions of the ice cubes in the ice cube storage bin to determine a degree of freshness.

2. The refrigerator according to claim 1, wherein the digital image capture device is constituted by a CCD camera.

3. The refrigerator according to claim 1, wherein the digital image capture device is constituted by a CMOS camera.

4. The refrigerator according to claim 1, further comprising: a light source, said light source bathing the ice cube storage bin in light for the digital image capture device.

5. The refrigerator according to claim 4, wherein the light source bathes the ice cube storage bin in non-visible light for evaluation by the digital image analyzing system.

6. The refrigerator according to claim 1, wherein the digital image analyzing system is further configured to evaluate freshness of the ice cubes in the ice cube storage bin based upon images obtained through the digital image capture device by determining an opacity of the ice cubes from the images.

7. A refrigerator comprising:

a cabinet including top, bottom, rear and opposing side walls that collectively define a refrigerator body having a freezer compartment;

a door for selectively providing access to the freezer compartment;

an ice maker mounted in the freezer compartment;

an ice cube storage bin for receiving ice cubes from the ice maker;

a digital image capture device focused upon the ice bin; and a digital image analyzing system operatively connected to the digital image capture device, said digital image analyzing system configured to evaluate an age of the ice cubes in the ice cube storage bin based upon images obtained through the digital image capture device by determining an opacity of the ice cubes from the images.

8. The refrigerator according to claim 7, further comprising: a light source, said light source bathing the ice cube storage bin in light for the digital image capture device.

9. The refrigerator according to claim 8, wherein the light source bathes the ice cube storage bin in non-visible.

10. The refrigerator according to claim 7, further comprising: a reference image formed with distinct regions which repeat within the image for providing a contrast to the ice cubes wherein said ice cube storage bin is positioned between the digital image capture device and the reference image and the digital image analyzing system is further configured to evaluate the digital images of ice cubes in the ice cube storage bin captured by the digital image capture device to determine a level of ice cubes in the ice cube storage bin while using the reference image as a point of comparison.

11. A method of analyzing ice cubes in an ice cube storage bin of a refrigerator comprising:

focusing a digital image capture device, attached to the refrigerator, on an ice cube storage bin;

capturing a digital image of ice cubes in the ice cube storage bin; and analyzing the digital image to determine an age of the ice cubes by determining an opacity of the ice cubes.

12. The method of claim 11, wherein determining a level of freshness further comprises evaluating edge portions of the ice cubes in the ice cube storage bin.

13. The method of claim 11, further comprising: bathing the ice cube storage bin in light prior to capturing the digital image.

14. The method of claim 11, wherein analyzing the image includes determining both the level and freshness of the ice cubes.

* * * * *